US005295844A

United States Patent [19]

Koshikawa et al.

[11] Patent Number: 5,295,844

[45] Date of Patent: Mar. 22, 1994

[54] CONNECTOR

[75] Inventors: Kiyoshi Koshikawa; Hiroyuki Fujieda, both of Mito; Takeshi Konno, Nagaoka, all of Japan

[73] Assignee: Mitsumi Electric Co., Ltd., Tokyo, Japan

[21] Appl. No.: 935,033

[22] Filed: Aug. 25, 1992

[51] Int. Cl.[5] ..... H01R 13/44; H01R 13/648

[52] U.S. Cl. ..... 439/138; 439/892; 439/95

[58] Field of Search ..... 439/136, 138, 140, 95, 439/101, 372, 505, 892, 910

[56] References Cited

U.S. PATENT DOCUMENTS 5,002,495 3/1991 Tanaka ..... 439/138

FOREIGN PATENT DOCUMENTS 2127235 4/1984 United Kingdom ..... 439/138

*Primary Examiner*—Paula A. Bradley

*Attorney, Agent, or Firm*—Paul A. Fattibene; Arthur T. Fattibene

[57] ABSTRACT

The present invention is a connector having a socket connector including a cover and a plug connector to be engaged with the socket connector, wherein the cover is made of metal, the metal cover is pivotally secured at its one end to a molded body to be rotatable, energized by a spring having a connecting portion to be connected to a ground, and the metal cover is conducted to the ground by the spring.

19 Claims, 15 Drawing Sheets

CONNECTOR

BACKGROUND OF THE INVENTION

This invention relates to a connector having a socket connector element having a socket terminal and a plug connector element having a plug terminal opposed to the socket terminal.

DESCRIPTION OF THE PRIOR ART

Heretofore, a conventional connector of this type will be described with reference to FIG. 25. In FIG. 25, reference numeral 1 denotes a socket connector. The socket connector 1 has a molded body 2, a plurality of socket terminals 3 in which its base portion 3*a* is mounted in a groove of the rear portion (left side in the drawing) of the molded body 3, and a cover 4 mounted on the molded body 2. Each socket terminal 3 is formed of a leaf spring to have elasticity, and formed to be bent upwards at its intermediate portion to form a contact portion 5. The cover 4 is formed of synthetic resin, and mounted vertically movably with respect to the molded body 2. The cover 4 covers the upper surface of the molded body 2, and is energized upwards by a spring 6. Accordingly, when the socket connector 1 is not used, the cover 4 prevents the socket terminals 3 from being deformed or damaged due to an external collision. Further, a window 7 is opened at the position of the contact portion 5 of the socket terminal 3 at the cover 4.

When the plug connector 8 is slid from the side on the upper surface of the cover 4 to be pressed, the cover 4 is moved down to expose the contact portion 5 of the socket terminal 3 from the window 7, and contacted with the plug terminal 9 of the plug connector 8.

Since the cover 4 is formed of synthetic resin, when a human being of a charged body approaches the socket connector 1, a static electricity is discharged to the socket terminal 3, and an electronic component such as an IC, etc., connected to the socket terminal might be damaged. Accordingly, an object of the present invention is to provided a socket which can prevent a static electricity from being discharged to a socket terminal and eliminate an anxiety of damaging an IC, etc.

Further, when the cover 4 of the socket connector 1 is mounted vertically movably on the molded body 2 through right and left springs 6, its assembling operability is wrong. Therefore, another object of the present invention is to provide a connector which facilitates the assembling work of a metal cover by pivotally supporting one end of the metal cover to both ends of the outside of the molded body, and reliably fixes the spring to the molded body when the metal cover is energized upwards by the spring to be associated, thereby easily mounting the socket connector on a board, etc.

The socket terminal 3 of the socket connector has elasticity so as to be brought into pressure contact with the plug terminal 9 of the plug connector 8, and if the socket terminal 3 is pressed by the plug connector 8 to be repeatedly bent, a so-called "permanent distortion" occurs due to fatigue. Accordingly, still another object of the present invention is to provide a connector which can prevent "a permanent distortion" of the socket terminal.

Moreover, when the cover 4 is, for example, of a metal cover and a separator is fixed to the window of the metal cover by insert molding synthetic resin, the separator might protrude above the upper surface of the cover to disturb the smooth sliding of the plug connector. Therefore, still another object of the present invention is to provide a connector in which the separator does not protrude from the upper surface of the cover and is reliably fixed to the window of the cover so as not to disturb the mounting operation of the plug connector.

The connector might be sometimes deviated at its center in a pitch direction at the time of engaging the connector due to an irregularity in dimensional accuracy of, for example, a car stereophonic player body and an operation panel, etc. In this case, terminals are short-circuited due to the central deviation, or an improper contact occurs. Accordingly, still another object of the present invention is to provide a connector in which, even if a central deviation in a pitch direction exists, a short-circuit between terminals or an improper contact of the terminals does not occur.

SUMMARY OF THE INVENTION

The present invention has been proposed so as to perform the above-described objects. There is provided a connector comprising a socket connector covered with a cover formed with a number of slits and mounted on the upper surface of a molded body including a plurality of socket terminals and formed to expose the socket connectors from the slits, and a plug connector having a plurality of plug terminals opposed to the socket terminals, wherein the cover is formed of metal, the metal cover is pivotally secured at its one end to the molded body to be rotatable, energized upwards by a spring, the spring has a connecting portion to be connected to a ground, thereby conducting the metal cover with the ground. There is also provided the connector, wherein the slits formed at the metal cover are respectively mounted, with separators formed of resin in a window opened at the metal cover. There is also provided the connector, wherein the spring for energizing upwards the metal cover is restricted in the upward movement of the spring by a first connecting portion provided at the connector body, and restricted in the downward movement of the spring by a second connecting portion to fix the spring to the connector body. There is also provided the connector, wherein the each socket terminal is fixed at its base portion to the rear portion of the molded body of the socket connector, bent obliquely upwards at the rear, further bent downwards above the molded body to form a contact portion at the top thereof, and extended rearwards at the distal end thereof. There is also provided the connector, wherein holes are opened at the sides of the window of the metal cover, and said separator is fixed to the edges of the holes and the window by insert molding. There is also provided the connector, wherein the pressing portion of the each socket terminal is provided on the rear surface of the metal cover, when the metal cover is pressed, the pressing portion presses the socket terminal to limit the protruding amount of the contact portion formed at the top of the socket terminal constantly. There is also provided the connector, wherein guides are stood at both sides of any of the metal cover and the plug connector, the side of the cover or the plug connector having the guide is detachably engaged with the inner surface of the guide, and a predetermined clearance is provided between the molded body of the socket connector and the metal cover. There is also provided the connector, wherein guides are stood at both sides of any of the metal cover and said plug connector, the side of the metal cover or the plug connector having no guide is detachably engaged with the inner surface of the guide, and further a predetermined clearance is provided between the inner surface of the guide and the side of the metal cover or the plug connector having no guide. There is also provided the connector, wherein guides protrude at both sides of the molded body of the socket connector at the exposed side of the socket terminal, the outer surface of the plug connector is engaged with the inner surface of the guide, and at least one of the upper portion of the inner surface of the guide or the distal end of the outer surface of the plug connector is cut out to form a tapered surface.

The socket connector engaged with the plug connector of the present invention is composed at the cover having a number of slits on the upper surface of the molded body engaged with the socket terminals, of metal. Accordingly, even if a human body of a charged body approaches the connector, a static electricity charged to the human body is not discharged to the terminals but discharged to the metal cover, and grounded to the spring for energizing the metal cover upwards to be removed.

The separator formed of resin is mounted in the window opened at the metal cover. Accordingly, the separator isolates the terminals arranged between the separators to prevent a short-circuit between the terminals. Further, the metal cover is energized upwards by the spring as described above, and the spring is restricted to move upwards or downwards by the first connecting portion and the second connecting portion provided at the molded body of the connector. Therefore, when the spring is inserted to the hole opened at the circuit board to connect it to the ground of the circuit board, the spring is easily inserted into the circuit board without vertically moving to be fixed.

The base portion of the terminal is mounted at the rear portion of the molded body of the socket connector, the connector terminal is bent to be folded obliquely at the front portion of the molded body, and further the connector terminal is bent downward above the molded body to form the contact portion at the top. Accordingly, since the socket terminal is folded and extended in the length, high elasticity is imparted. Further, when the socket terminal is pressed by the pressing portion provided on the rear surface of the metal cover, its stress is dispersed to the contact portion, the folded front portion and the base portion of the socket terminal, and hence the reduction in the elastic force due to bending can be prevented.

The holes are opened at the sides of the window of the metal cover, and the separators of synthetic resin are fixed to hold the edges of the holes and the window horizontally by insert molding. Accordingly, since the separators can be mounted in the window of the metal cover without protruding from the upper surface of the metal cover, it is not necessary to form the step at the edge of the window of the metal cover, and to smoothly form the upper surface of the metal cover.

Further, when the plug connector to be connected is contacted with the metal cover of the socket connector and pressed at the metal cover, the metal cover is rotated at the pivotal support as a pivotal fulcrum to be pressed down, and the contact portion of the connector terminal is exposed from the slit of the separator. Further, when the metal cover is pressed down, the pressing portion provided on the rear surface of the metal cover presses the connector terminal to be pressed down. Thus, the protruding amount of the contact portion of the connector terminal is restricted constantly to reduce the deformation, and a breakage accident.

When the plug connector is electrically coupled with the socket connector, the side of the metal cover of the plug connector or the socket connector having no guide is engaged with the inner surface of the guide provided at either one of the plug connector and the metal cover of the socket connector. In this case, if its center is deviated in a pitch direction, the inner surface of the guide is interfered with the side of the metal cover of the plug connector or the socket connector having no guide to be engaged therewith, and the metal cover is slid to either one in a range of the clearance between the metal cover and the molded body of the socket connector for pivotally securing the metal cover. At this time, the sidewall of the slit of the metal cover is contacted with the side of the socket terminal, and the socket terminal is moved together with the slide of the metal cover. Thus, the plug terminal of the plug connector and the socket terminal of the socket connector are always held at a necessary contact state with respect to the central deviation of the connector, and not short-circuited. The contact of the plug terminal with the socket terminal can be held excellently even by providing the predetermined clearance between the inner surface of the guide and the plug connector or the metal cover having no guide, thereby preventing the short-circuit therebetween.

Further, the short-circuit can be also prevented by engaging the outer surface of the plug connector with the guides protruding from both sides of the molded body of the socket connector. In this case, the outer surface of the plug connector is inserted under the guidance of the tapered surface formed at either one of the upper portion of the inner surface of the guide or the distal end of the outer surface of the plug connector, and engaged with the inner surface of the guide. Even if the inserting direction of the plug connector is deviated at its center in the pitch direction, a predetermined clearance is provided between the inner surface of the guide and the outer surface of the plug connector, and hence the plug connector is slid in the range of the clearance to automatically correct the central deviation to the socket connector, thereby holding the contact state of the plug terminal with the socket terminal preferably to prevent the short-circuit therebetween.

BRIEF DESCRIPTION OF THE DRAWINGS

FIG. 1 is a plan view of a socket connector, FIG. 2 is a sectional view of the socket connector, FIG. 3 is a side view of the socket connector, FIG. 4 is an enlarged sectional view of first and second connecting portions of a spring for energizing a metal cover of the socket connector upwards, FIG. 5 is an enlarged sectional view of a separator portion mounted in the metal cover, FIG. 6 is a sectional view showing the state that the metal cover is rotated at the maximum angle, FIG. 7(A) is a sectional view of the socket connector showing the state that the pressing portion provided at the separator protrudes from the inner surface of the front portion of the separator, FIG. 7(B) is a sectional view of the socket connector showing another embodiment of the separator provided at the metal cover, and FIG. 8 is a sectional view showing the state that the socket connector and the plug connector are connected.

FIG. 9 is a front view of a plug connector, FIG. 10 is a partial longitudinal sectional front view of the socket connector, FIG. 11 is a partial longitudinal sectional front view of the socket connector of another embodiment, FIG. 12 is a front view of the plug connector of the embodiment, FIG. 13 is a plan view of the socket connector shown in FIG. 10, and FIG. 14 is a plan view of the socket connector shown in FIG. 11.

FIG. 15 is a front view of a connector of the still another embodiment, FIG. 16 is a partial longitudinal sectional front view of the socket connector, FIG. 17 is a partial longitudinal sectional front view of the socket connector of the embodiment, FIG. 18 is a front view of the plug connector of the embodiment, FIG. 19 is a plan view of the socket connector shown in FIG. 16, and FIG. 20 is a plan view of the socket connector shown in FIG. 17.

FIG. 21 is a front view showing the state that the plug connector and the socket connector are opposed, FIG. 22 is a side view of FIG. 21, FIG. 23 is a back view of the socket connector, FIG. 24 is a front view of the socket connector.

DETAILED DESCRIPTION OF THE PREFERRED EMBODIMENTS

FIGS. 1 to 8 show embodiments of the present invention.

Figure 1:
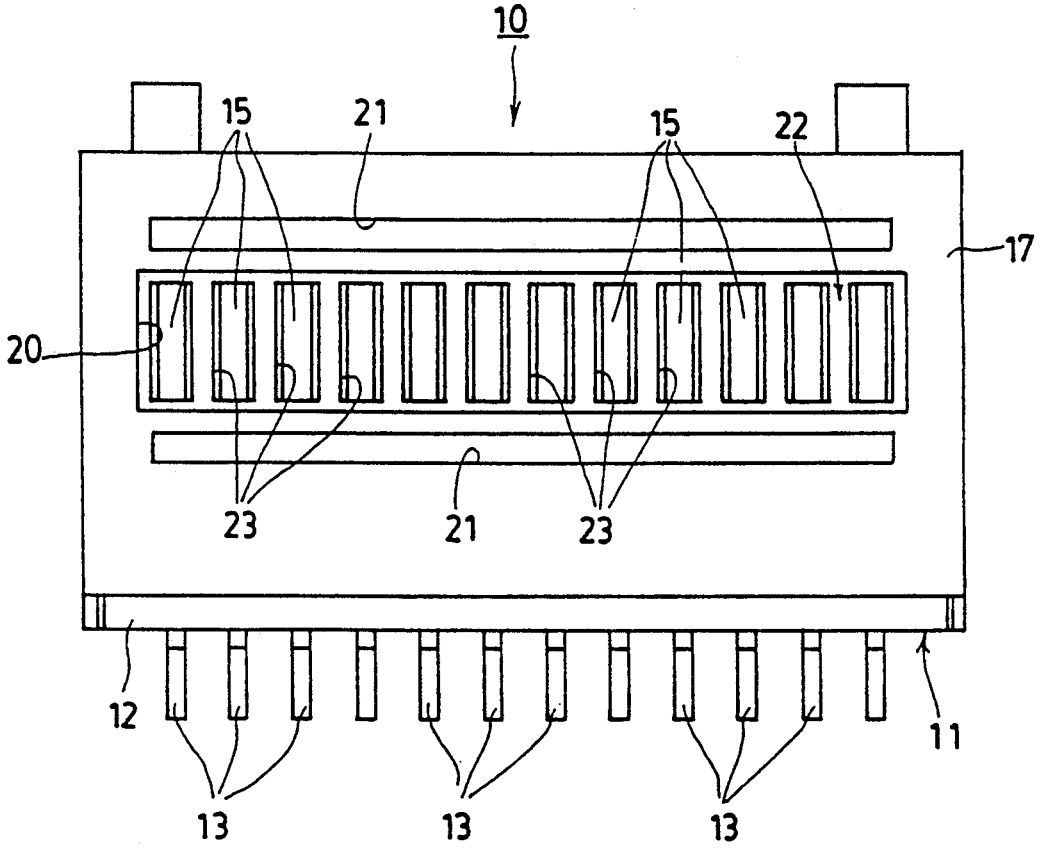
FIGS. 1 to 8 show an embodiment of a connector according to the present invention; where
Figure 2:
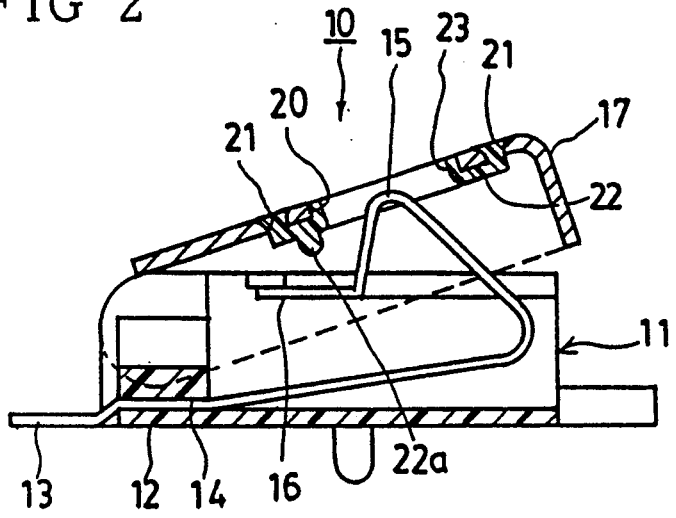

An embodiment of the present invention will now be described in detail with reference to FIGS. 1 to 8. In the drawings, reference numeral 10 denotes a socket connector to be used for a car stereophonic player (not shown) in which an operation unit engaged with a plug connector 26 to be described later can be attached and detached. As shown in FIGS. 1 and 2, in the socket connector 10, a plurality of socket terminals 13 are mounted in such a manner that the base portions 14 of the plurality of socket terminals 13 are fixed to the rear portion 12 of a molded body 11. Each socket terminal 13 is formed of a leaf spring to have an elastic force, and the base 14 portion of each socket terminal 13 is bent slightly upwards to be extended forward (rightward in FIG. 2) from the bottom of the rear portion 12 of the molded body 11. At the front portion of the molded body 11 each socket terminal 13 is bent upwards to be extended obliquely rearwards, further bent downwards to form a contact portion 15 protruding upwards, and the distal end portion 16 of the socket terminal 13 is horizontally extended.

As described above, the socket terminal 13 is bent to be folded at the front portion of the molded body 11, and bent above the molded body 11. Hence, a load for bending the socket terminal 13 by pressing of a pressing portion 22*a* of a separator 22 to be described later is dispersed by the base portion 14, the front portion and the contact portion 15 to prevent its elasticity from decreasing. Further, since the socket terminal 13 is folded at the front portion to extend the entire length, a decrease in the elasticity is further prevented.

Figure 3:
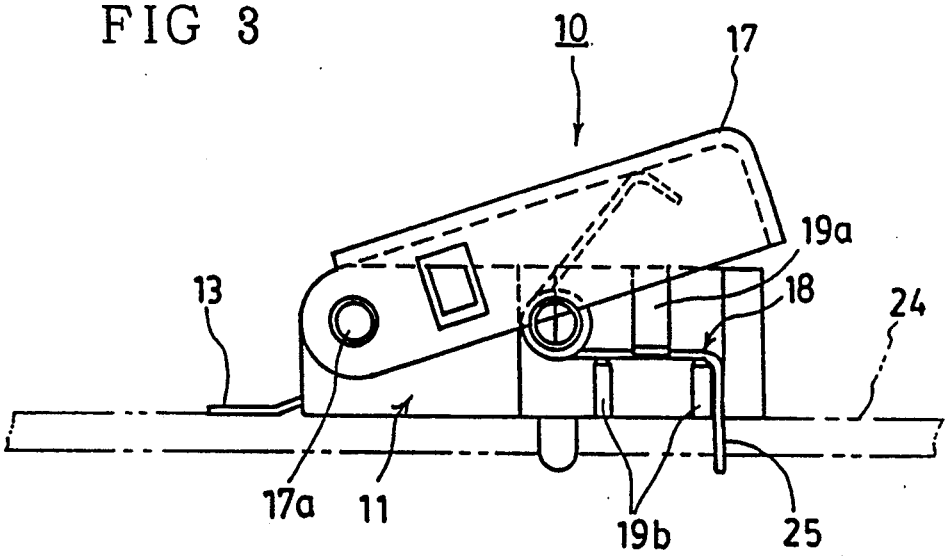
Figure 4:
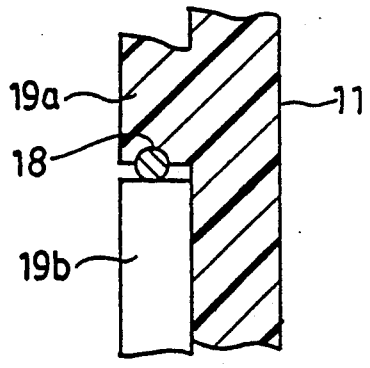

As shown in FIG. 3, a cover 17 covering from above the molded body 11 is vertically movably pivotally secured to the rear portion of the molded body 11. The cover 17 is formed of metal. As shown in FIG. 3, the metal cover 17 is pivotally secured to pins 17*a* at both sides of the rear portions of the molded body 11, a torsion coil spring 18 is mounted in the molded body 11 in such a manner that the torsion coil spring 18 is connected at the one side portion to the molded body 11 and contacted at the other end portion with the inner surface of the metal cover 17 to upwardly energize the metal cover 17. Accordingly, when the socket connector 10 is not used, the metal cover 17 covers to protect the socket terminals 13.

A first connecting portion 19*a* protrudes from the upper end portion of the side surface of the molded body 11 to the lower intermediate portion, and a second connecting portion 19*b* protrudes from the lower end of the side surface of the molded body 11 to the upper intermediate portion. A semicylindrical groove is formed on the lower end part of the first connecting portion 19*a*, the torsion coil spring 18 is engaged with the groove, the one side portion of the torsion coil spring 18 is held by the first connecting portion 19*a* and the second connecting portion 19*b*, and fixed to the side surface of the molded body 11.

Figure 5:
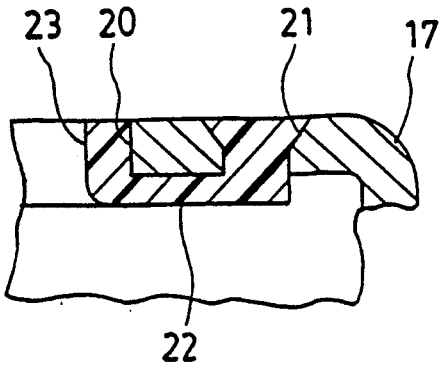

Further, as shown in FIGS. 1 and 2, a rectangular window 20 is opened at the intermediate portion of the metal cover 17, and long rectangular holes 21 are opened at the front and rear portions of the window 20. Each hole 21 is formed, as shown in FIGS. 2 and 5, to be extended at its upper portion in a tapered shape. Separators 22 formed of synthetic resin are mounted in the window 20. Each separator 22 is fixed to the edge portions of the window 20 by means of an insert molding to surround the sides between the window 20 and the holes 21, and the lower surface of the metal cover 21, and formed with a slit 23. Each slit 23 is formed oppositely to the socket terminal 13 in such a manner that the contact portion 15 of the socket terminal 13 is movably inserted into the slit 23. Accordingly, the socket terminals 13 are separated from each other by the separators 22.

Each separator 22 is insert molded the holes 21 opened upwards, and fixed at the tapered portion to prevent the separator 22 from dropping downwards. Since the separator 22 does not protrude over the upper surface of the metal cover 17, a plug connector 26 to be described later may be smoothly slid on the upper surface of the metal cover 17 as will be described later. As shown in FIG. 7(B), it is noted that a step portion 21*a* is formed on the metal cover 7 and the separator 22 may be mounted in the step portion 21*a* so that the separator 22 does not protrude from the upper surface of the metal cover 17.

Figure 6:
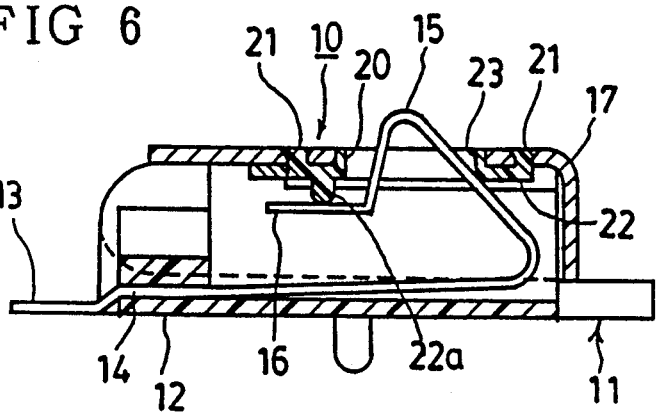
Figure 7:
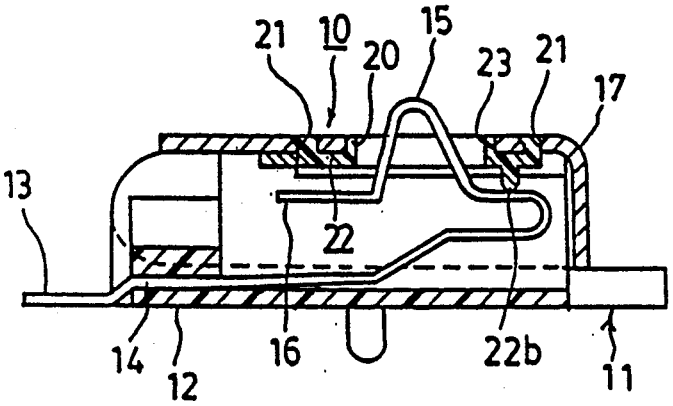
Figure 7:
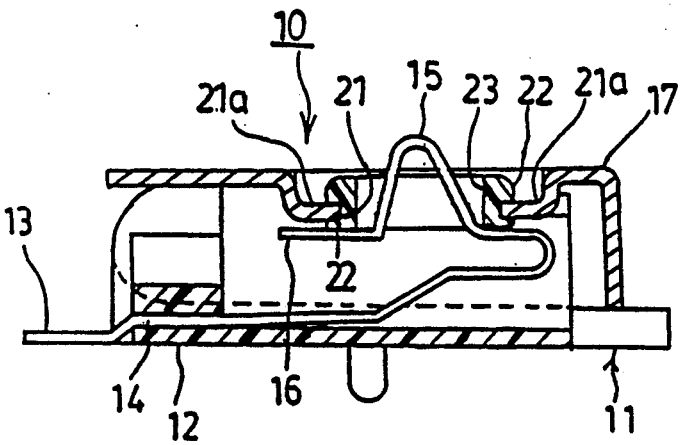

As shown in FIG. 2, the pressing portion 22*a* protrudes from the inner surface of the rear portion of each separator 22. As shown in FIG. 6, even if the metal cover 17 is strongly pressed so that the rotating angle of the metal cover 17 is increased, the pressing portion 22*a* presses the distal end 16 of the socket terminal 13 to cooperatively rotate it by the provision of the pressing portion 22*a*. Hence, the contact portion 15 of the socket terminal 13 is moved downwards to restrict the excessive protrusion from the metal cover 17. Further, since the socket terminal 13 is bent to be folded at the front portion of the molded body 11 and the socket terminal 13 is bent downwards above the molded body 11, a load for bending the socket terminal 13 by pressing the pressing portion 22*a* as described above is dispersed to the base portion 14, the front portion and the contact portion 15 thereby to prevent the elastic force from decreasing.

In FIG. 7(A), a pressing portion 22b protrudes from the inner surface of the front portion of the separator 22. The pressing portion 22b is constructed to press the front portion of the contact portion 15 of the socket terminal 13 when the metal cover 17 is largely rotated. In this case, since the position to be pressed by the pressing portion 22b is set between the contact portion 15 and the base portion 14, the protruding amount of the contact portion 15 provided at the distal end side, from the metal cover 17 is stabilized so as to make the protruding heights of a number of socket terminals aligned in parallel uniform.

Therefore, when the socket connector 10 is not used, even if the metal cover 17 is pressed due to any external collision, the protruding amounts of the socket terminals 13 are maintained constantly to be restricted, and hence the deformation or damage of the exposed portion of the socket terminal 13 due to an engagement can be prevented.

The socket connector 10 is mounted on a circuit board 24, and the socket terminals 13 are connected to the electrodes of the board. On the other hand, as shown in FIG. 3, the torsion coil spring 18 is extended downwards at its one side from the second connecting portion 19b to form a connecting portion 25. The connecting portion 25 is inserted into an insertion hole of the circuit board 24, and connected to a ground pattern (not shown) of the circuit board 24. At this time, since the vicinity of the connecting portion 25 of the torsion coil spring 18 is restricted to move upwards, downwards and rightward, leftward by the first connecting portion 19a and the second connecting portion 19b, the vertical fluctuations of the connecting portion 25 are prevented, and an inserting work of the connecting portion 25 into the circuit board can be facilitated. Accordingly, even if the connecting portion 25 is not soldered to the board but used in the state that the connecting portion 25 is pressed in contact with metal, etc., the opening force of the metal cover 17 is maintained constantly.

Figure 8:
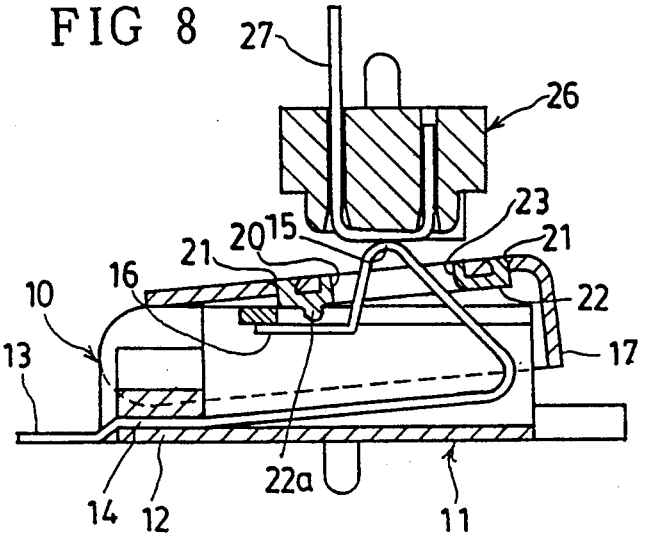

As shown in FIG. 8, when the plug connector 26 is slid from the front of the socket connector 10 on the upper surface of the metal cover 17 and the plug connector 26 is opposed to the upper surface of the slit 23 while pressing the oblique surface of the inclined metal cover 17, the metal cover 17 is rotated downwards, and the contact portion 15 of the socket terminal 13 is exposed from the slit 23. Accordingly, the contact portion 15 of the socket terminal 13 of the socket connector 10 is press-contacted with the plug terminal 27 of the plug connector 26. In FIG. 8, an interval is provided between the plug connector 26 and the upper surface of the metal cover 17 for the convenience of description, the plug connector 26 is actually contacted with the upper surface of the metal cover 17 of the socket connector 10.

In this case, since an interval is provided between the front edge of the separator 22 and the distal end 16 of the socket terminal 13, the metal cover 17 is not interfered with the socket terminal 13 of the socket connector 10 before the front edge of the separator 22 is contacted with the distal end 16 of the socket terminal 13, i.e., when the falling amount of the metal cover 17 is short. Accordingly, the contact portion 15 of the socket terminal 13 is exposed from the slit 23, and pressed in contact with the plug terminal 27 of the plug connector 26.

It is noted that the contact timing of the contact portion 15 of the socket terminal 13 with the plug terminal 27 can be altered by varying the height of the pressing portion 22a shown in FIG. 2. Accordingly, for example, the contact portion 15 of the socket terminal 13 is sequentially contacted with a ground terminal, a power terminal, a signal terminal to be able to prevent damage of an IC, etc.

On the other hand, since the metal cover 17 is formed of metal, even if a charged body such as a human body, etc., is approached to the socket connector 10, a static electricity is not discharged to the socket terminal 13, but discharged to the metal cover 17. The static electricity is discharged to the ground through the torsion coil spring 18. Further, since the separator 22 is formed of resin, even if it is contacted with the socket terminal 13, it is not short-circuited, but it reliably isolates the socket terminals 13 to protect it. Therefore, an anxiety of damaging electronic components such as an IC, etc., connected to the socket terminal 13 is eliminated.

Figure 9:
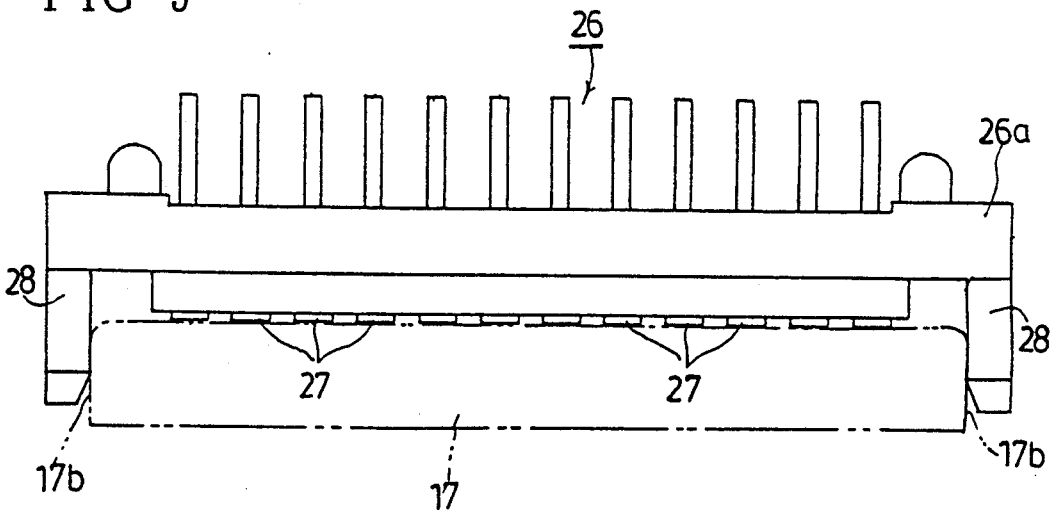
FIGS. 9 to 14 show another embodiment of a connector according to the present invention where

Then, another embodiment according to the present invention will be described in detail with reference to FIGS. 9 to 14. The corresponding portions in this embodiment to those of the above-described constitution are designated by the same reference numerals as those in the embodiment in FIGS. 1 to 8 for the convenience of description. FIG. 9 is a front view of a plug connector 26. In FIG. 9, in the plug connector 26, a number of plug terminals 27 are exposed in the longitudinal direction (central direction) of the bottom of a molded body 26a to be inserted, and the other ends of the plug terminals 27 protrude from the upper surface to be soldered to a wiring pattern of a board (not shown). In FIG. 9, guides 28 protrude from the lower surfaces of both end portions of the molded body 26a to be engaged with right and left outer surfaces 17b of a metal cover 17 in which socket connectors 10 are pivotally secured to be described later (see FIG. 10).

Figure 10:
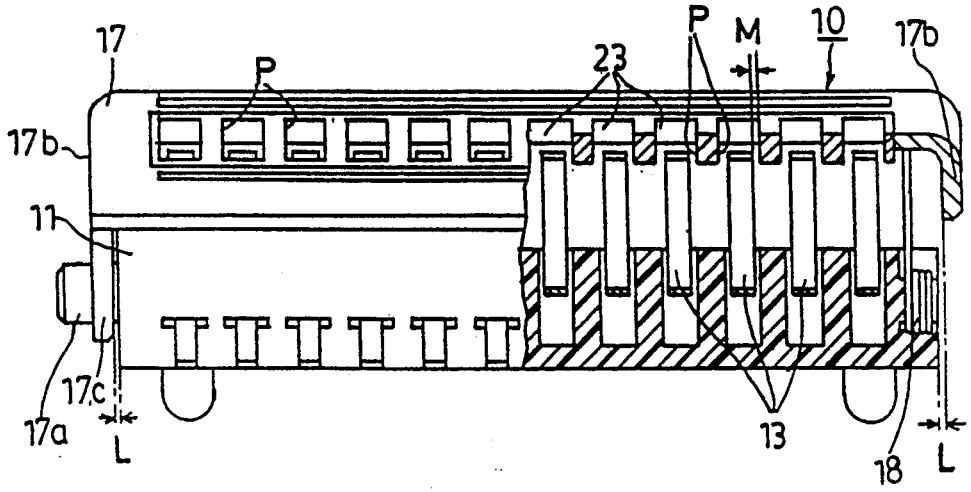

On the other hand, in a socket connector 10, as shown in a partial sectional front view of FIG. 10, the metal cover 17 covers the upper surface of the molded body 11 of the socket connector 10, and the lower end portions of the right and left side plates 17c of the metal cover 17 are pivotally secured to the side surfaces of the lower end portion of the molded body 11 via pins 17a. Accordingly, the metal cover 17 is composed vertically rotatably at the pins 17a as rotary fulcra, and energized by a spring 18 in a direction for opening (upwards) the metal cover 17.

A predetermined clearance L is provided between the inner surface of the pivotal support position of the side plate 17c of the metal cover 17 and the outer surface 11a of the molded body 11. Further, a plurality of socket terminals 13 are aligned to be exposed in the longitudinal direction of the upper surface of the molded body 11, respectively opposed to the plug terminals 27 in such a manner that the opposed plug terminals 27 and the socket terminals 13 are respectively contacted with each other. Of course, the other ends of the socket terminals 13 protrude at the front surface side in FIG. 10 to be soldered to a wiring pattern of a board (not shown).

Slits 23 are opened oppositely to the socket terminals 13 longitudinally of the upper surface of the metal cover 17. When the metal cover 17 is rotated to the side of the molded body 11 against the energization of the spring 18, the socket terminals 13 are exposed upwards from the slits 23. Further, a clearance M is provided between the sidewall P of the slit 23 and both side surfaces of the socket terminal 13. Thus, it is noted that the clearance M is formed to be shorter than the clearance L between the metal cover 17 and the molded body 11.

Figure 11:
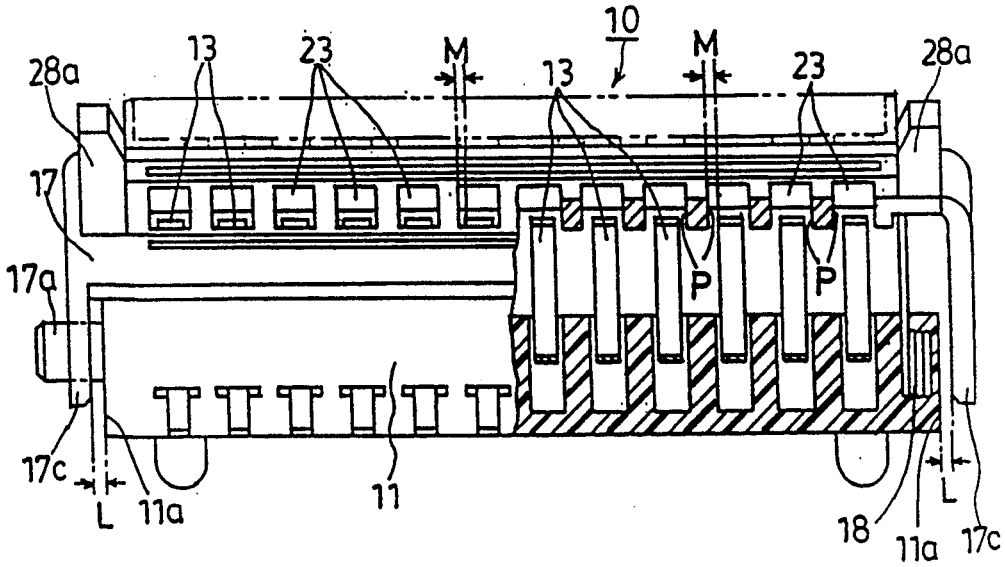

Then, still another embodiment of the invention will be described with reference to FIGS. 11 and 12. FIG. 11 is a front view of a socket connector 10.

Since the socket connector 10 shown in FIG. 10 has substantially the same as the socket connector 10 described with reference to FIG. 10, the corresponding portions are designated by the same reference numerals as those of the socket connector 10 of FIG. 10, and the description thereof will be omitted.

Figure 12:
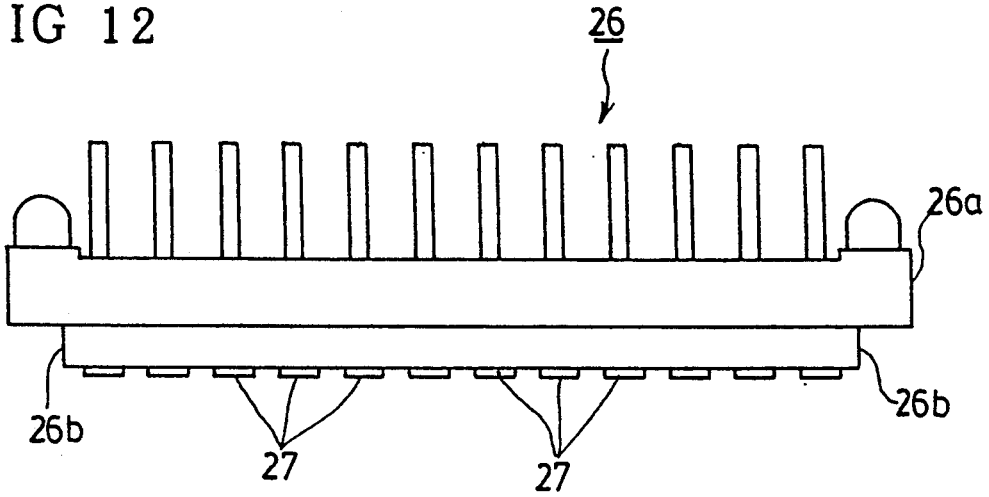

Only a different point of this embodiment from that in FIG. 10 is that guides 28*a* protrude from both side portions of the upper surface of the metal cover 17 to be engaged at the outer surface of the plug connector 26 shown in FIG. 12 with the inner surface of the guide 28*a*.

The plug connector 26 to be engaged with the guide 28*a* of the socket connector 10 shown in FIG. 11 will be described with reference to FIG. 12. FIG. 12 is a front view of the plug connector 26, which is substantially the same as the plug connector 26 shown in FIG. 9. Only a different point is that guides 28 are not provided at both ends of the lower portion of the molded body 26*a* shown in FIG. 9. Since the other points are entirely the same as those in FIG. 9, the corresponding portions are designated by the same reference numerals as those of the socket connector 10 of FIG. 9, and the description thereof will be omitted. In this embodiment, the portions engaged with the guides 28*a* are right and left sidewalls 26*b* formed at the lower protrusions of the molded body 26*a* in which the plug terminals 27 are exposed to be inserted in FIG. 12. However, the present invention is not limited to the particular embodiment.

Figure 13:
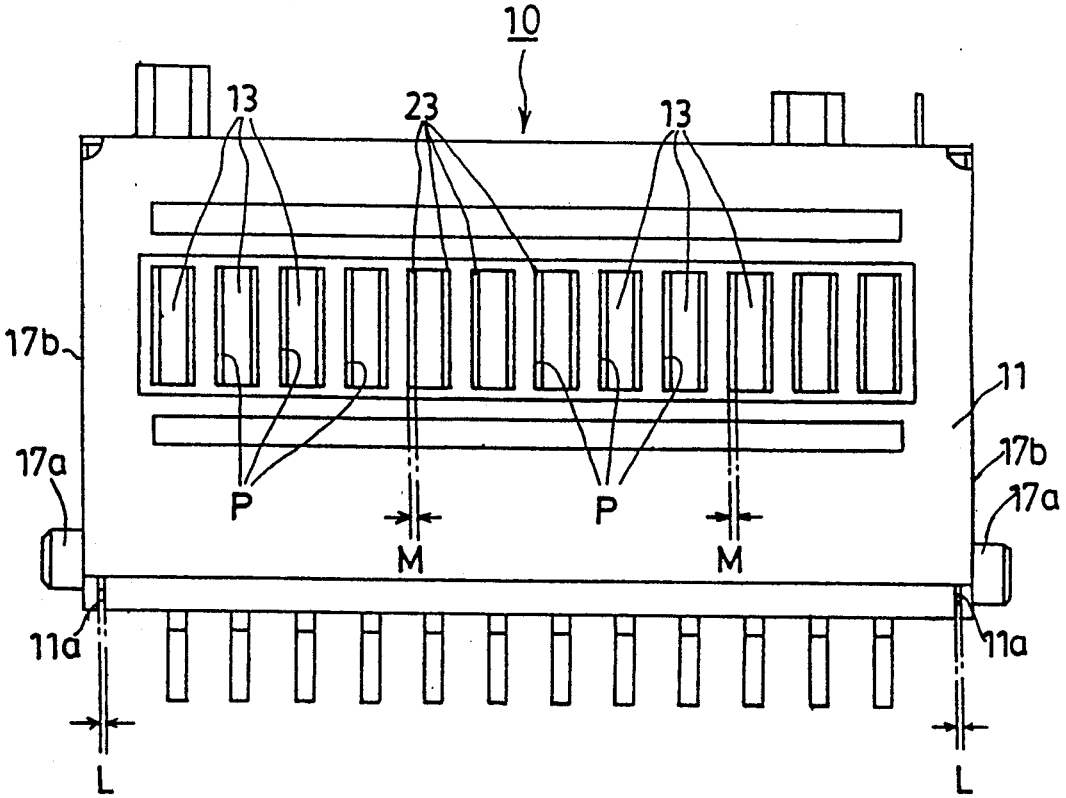
Figure 14:
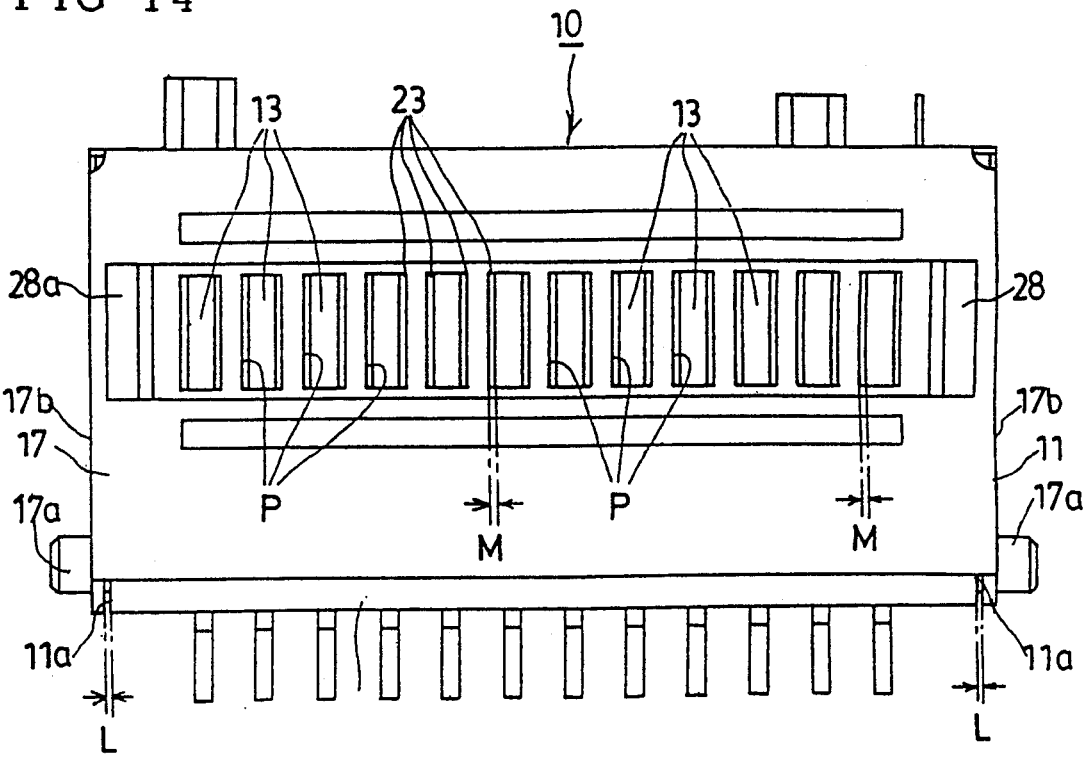

FIG. 13 is a plan view of the socket connector 10 shown in FIG. 10, and FIG. 14 is a plan view of the socket connector 10 shown in FIG. 11. Accordingly, in FIG. 13, the guides 28*a* are not provided, but in FIG. 14, the guides 28*a* are provided. The other construction is entirely the same.

Since the above-described embodiments of the present invention are constructed as described above, when the plug connector 26 is engaged with the socket connector 10 to be electrically coupled, for example, in FIG. 9, the outer surface 17*b* of the metal cover 17 pivotally supported to the upper surface of the socket connector 10 shown in FIG. 10 is guided to be engaged with the inner surface of the guide 28 of the plug connector 26, or in FIG. 11, the sidewall 26*b* of the molded body 26*a* of the plug connector 26 shown in FIG. 12 is guided to be engaged with the inner surface of the guide 28*a* provided at the metal cover 17 of the socket connector 10. In this case, if the deviation of the center in a pitch direction (lateral longitudinal direction in the drawings), the outer surfaces 17*b* of the metal cover 17 to be engaged with the guides 28 or the sidewalls 26*b* of the plug connector 26 to be engaged with the guides 28*a* are interfered with each other, and the metal cover 17 is slid in either one direction of rightward and leftward longitudinal directions. The sliding of the metal cover 17 is conducted in a range of the clearance L provided between the metal cover 17 and the outer surface 11*a* of the molded body 11. (The moving range of the socket terminal 13=clearance L - clearance M). In this case, the inner sidewall of the slit 23 of the metal cover 17 is interfered with the sidewall of the socket terminal 13, and as the metal cover 17 slides, the socket terminal 13 also moves. Thus, the central deviation of the plug connector 26 and the socket connector 10 is corrected at the contact deviation between the terminals in cooperation of the terminals in the deviated direction of the contact portions of the terminals.

Figure 15:
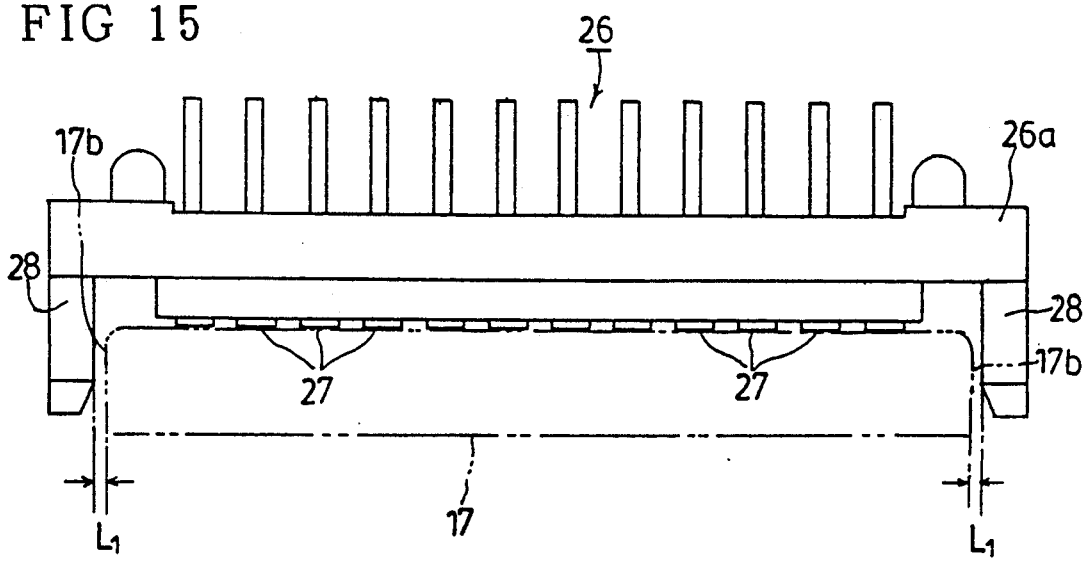
FIGS. 15 to 20 show still another embodiment of a connector according to the present invention, where

Then, still another embodiment of the present invention will be described in detail with reference to FIGS. 15 to 20. FIG. 15 is a front view of a plug connector 26. Since FIG. 15 shows the same as the plug connector 26 shown in FIG. 9, the corresponding portions are designated by the same reference numerals as those of the socket connector 10 of FIG. 9, and the description thereof will be omitted.

Figure 16:
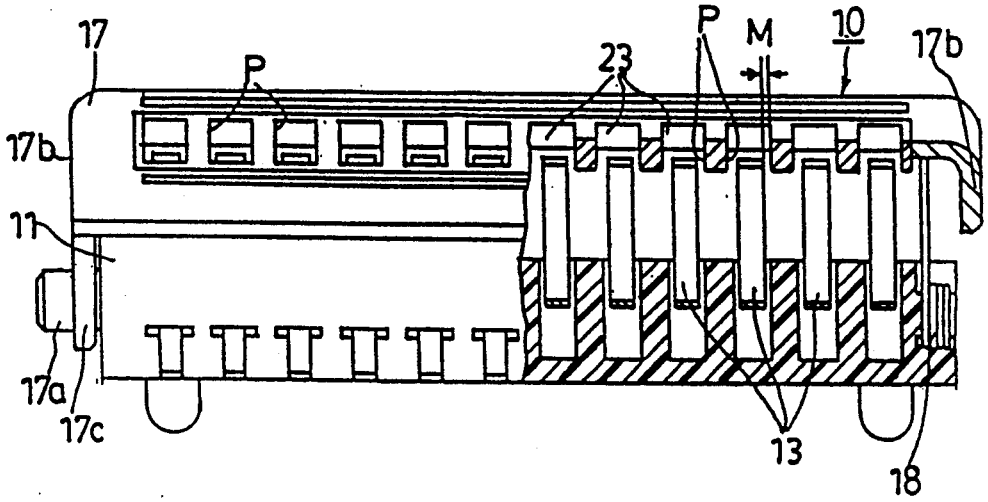

On the other hand, the socket connector 10 shown in a partial sectional front view of FIG. 16 is the same as the socket connector 10 in FIG. 10, the corresponding portions are designated by the same reference numerals as those of the socket connector 10 of FIG. 10, and the description thereof will be omitted.

As shown in FIG. 15, a clearance $L_1$ is provided between the inner surface of the guide 28 protruding from the plug connector 26 and the outer surface 17*b* of the metal cover 17. Further, a clearance M is provided between the sidewall P of the slit 23 provided on the metal cover 17 and both the side surfaces of each socket terminal 13. The clearance M is may be formed shorter than a clearance $L_1$ provided between the inner surface of the guide 28 and the outer surface 17*b* of the metal cover 17.

Figure 17:
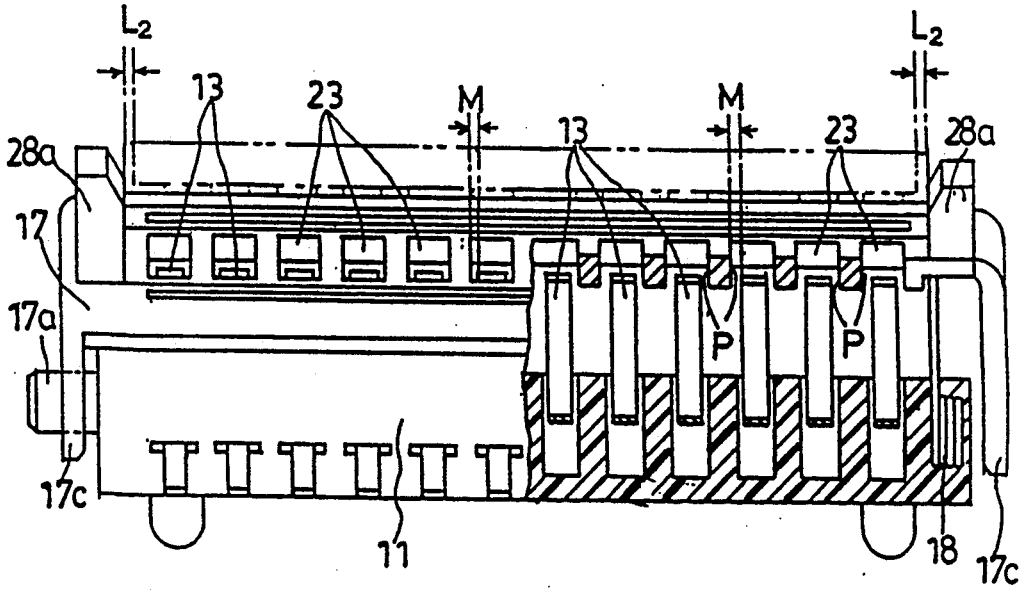

Then, still another embodiment of the present invention will be described with reference to FIGS. 17 and 18. FIG. 17 is a front view of a socket connector 10. The socket connector 10 shown in FIG. 17 is substantially the same as the socket connector 10 shown in FIG. 16, the corresponding portions are designated by the same reference numerals as those of the socket connector 10 of FIG. 16, and the description thereof will be omitted. Only a different point is that guides 28*a* protrude from both side portions of the upper surface of the metal cover 17 to be engaged at the outer surface of the plug connector 26 shown in FIG. 18 with the guides 28*a*.

The plug connector 26 to be engaged with the guides 28*a* of the socket connector 10 shown in FIG. 17 will be described with reference to FIG. 18. FIG. 18 is a front view of the plug connector 26, and substantially the same as the plug connector 26 shown in FIG. 15. Only a different point is that guides 28 are not provided at both ends of the lower portion of the molded body 26*a* shown in FIG. 15. Since the other points are entirely the same, the corresponding portions are designated by the same reference numerals as those of the socket connector 10 of FIG. 15, and the description thereof will be omitted. The portions to be engaged with the guides 28*a* are right and left sidewalls 26*b* formed at the protrusions of the lower portion of the molded body 26*a* in which the plug terminals 27 are exposed to be inserted in FIG. 18. However, the present invention is not limited to the particular embodiment. Further, a predetermined clearance $L_2$ is provided between the inner surface of the guide 28*a* provided at the metal cover 17 and the sidewall 26*b* of the plug connector 26.

Figure 19:
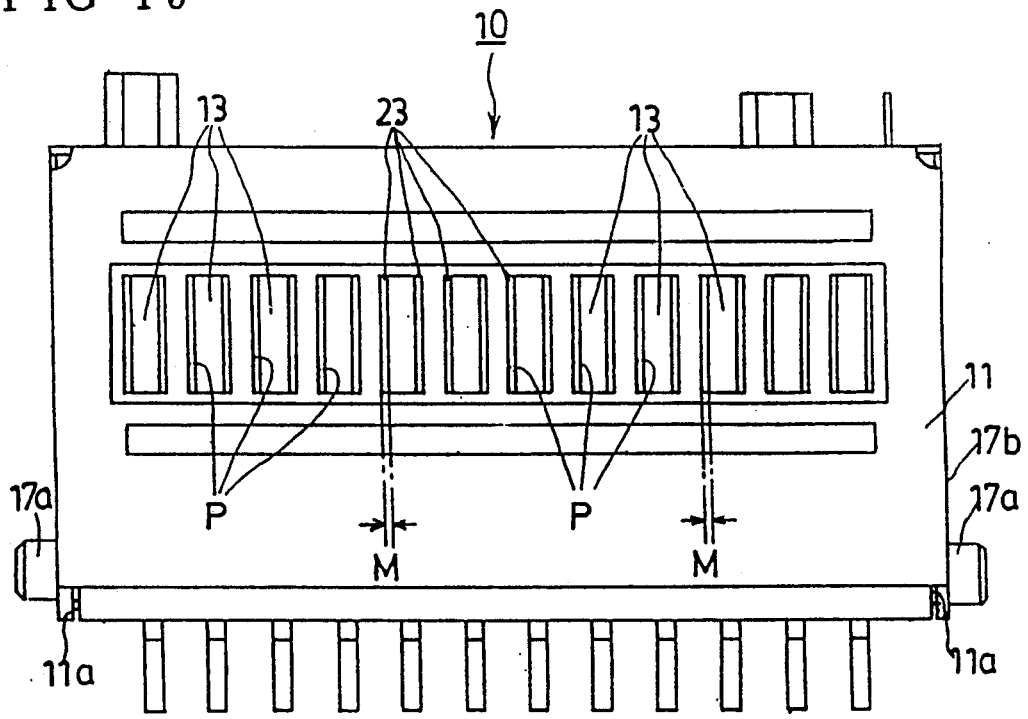
Figure 20:
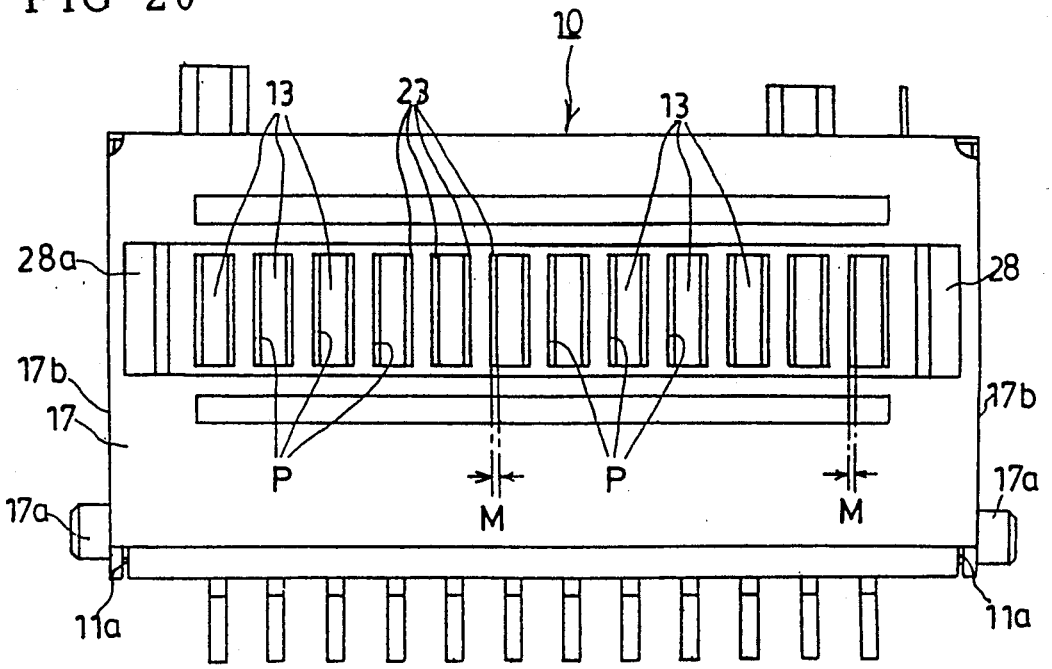

FIG. 19 is a plan view of the socket connector 10 shown in FIG. 16, and FIG. 20 is a plan view of the socket connector 10 shown in FIG. 17. Accordingly, guides 28*a* are not provided in FIG. 19, but the guides 28a are provided in FIG. 20, and the other structure is entirely the same.

Figure 18:
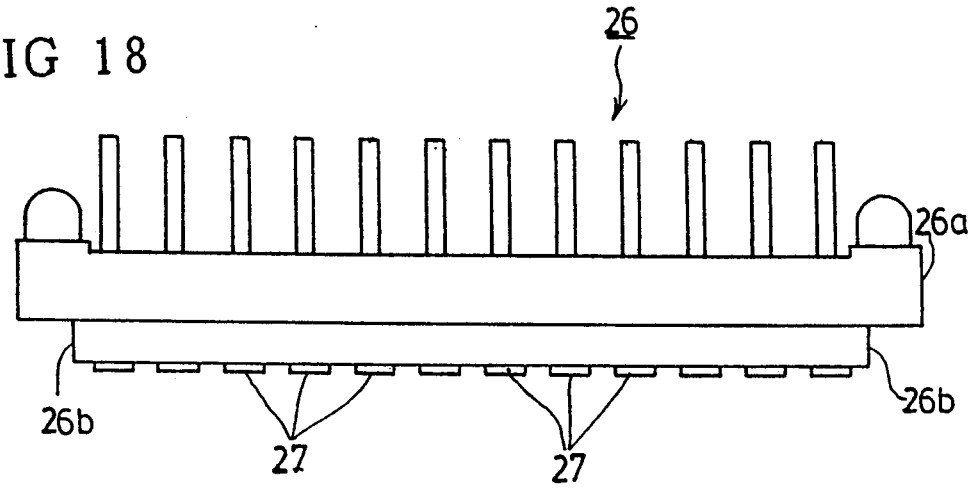

Since the above-described embodiments of the present invention are constructed as described above, when the plug connector 26 is engaged with the socket connector 10 to be electrically coupled, for example, in FIG. 15, the outer surface 17b of the metal cover 17 pivotally supported to the upper surface of the socket connector 10 shown in FIG. 16 is guided to be engaged with the inner surface of the guide 28 of the plug connector 26, or in FIG. 17, the sidewall 26b of the molded body 26a of the plug connector 26 shown in FIG. 18 is guided to be engaged with the inner surface of the guide 28a provided at the metal cover 17 of the socket connector 10. In this case, if the deviation of the center in a pitch direction (lateral longitudinal direction in the drawings), the outer surfaces 17b of the metal cover 17 to be engaged with the guides 28 or the sidewalls 26b of the plug connector 26 to be engaged with the guides 28a are interfered with each other, and the metal cover 17 is slid in either one direction of rightward and leftward longitudinal directions. The sliding of the metal cover 17 is conducted in a range of the clearance $L_1$ between the inner surface of the guide 28 and the outer surface 17b of the metal cover 17 or in a range of the clearance $L_2$ between the inner surface of the guide 28a and the sidewall 26b of the plug connector 26. Thus, the central deviation when the connector is set to be engaged can be absorbed by the clearance $L_1$ or $L_2$ to correct the contact deviation of the terminals.

Figure 21:
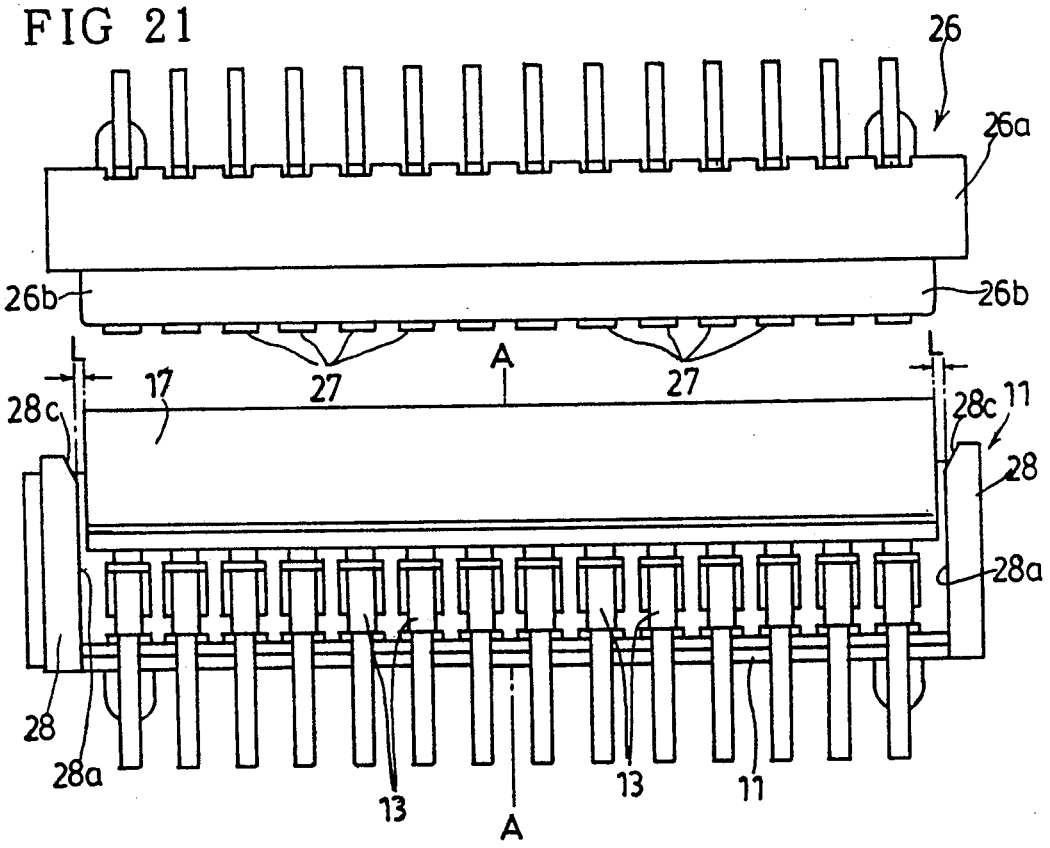
FIGS. 21 to 24 show still another embodiment of a connector according to the present invention, where
Figure 22:
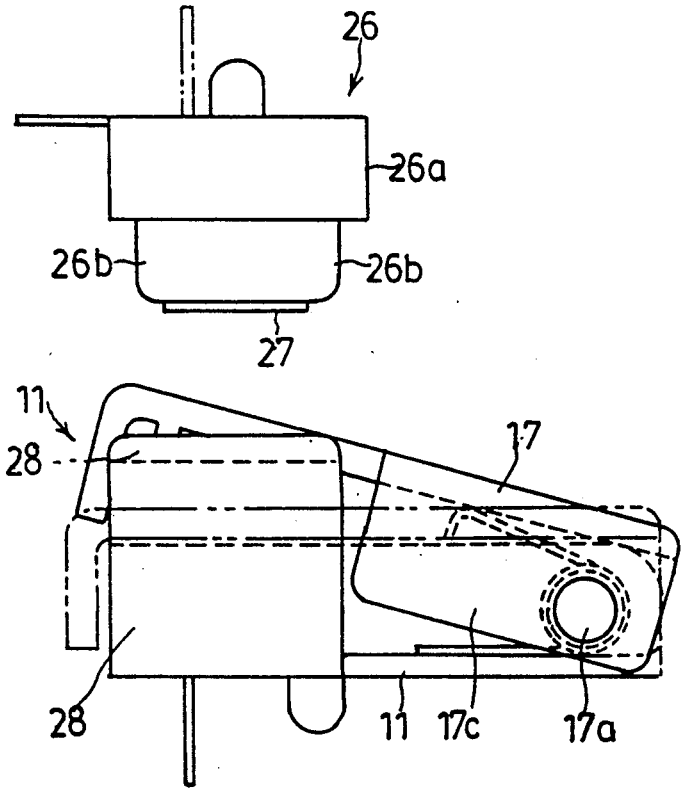
Figure 23:
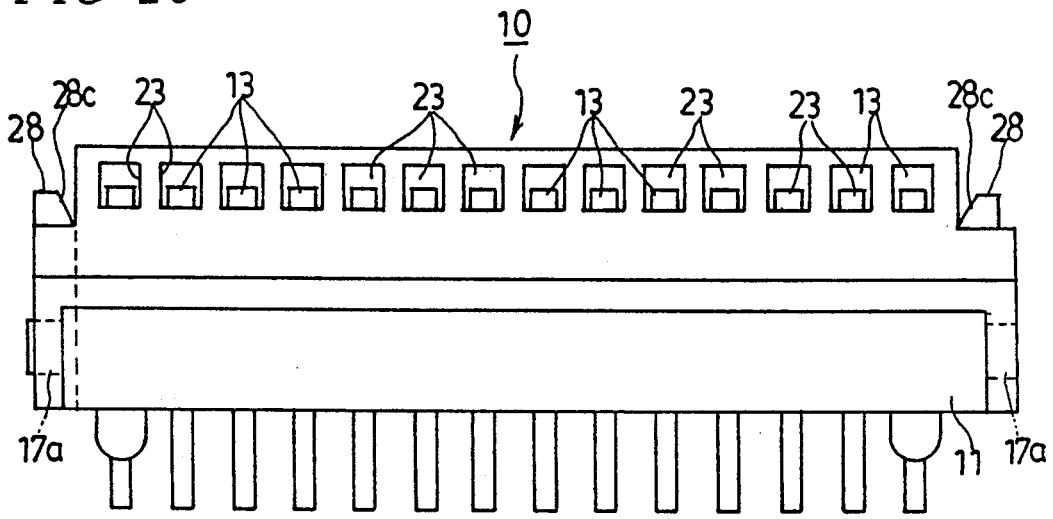
Figure 24:
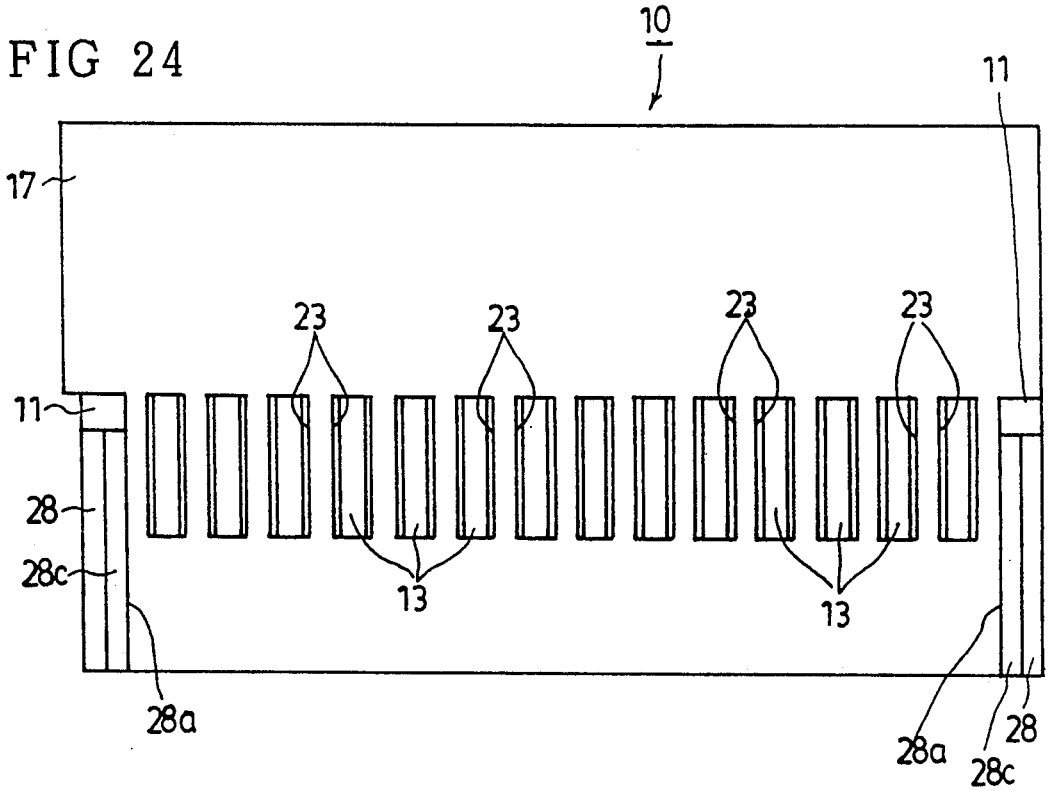
Figure 25:
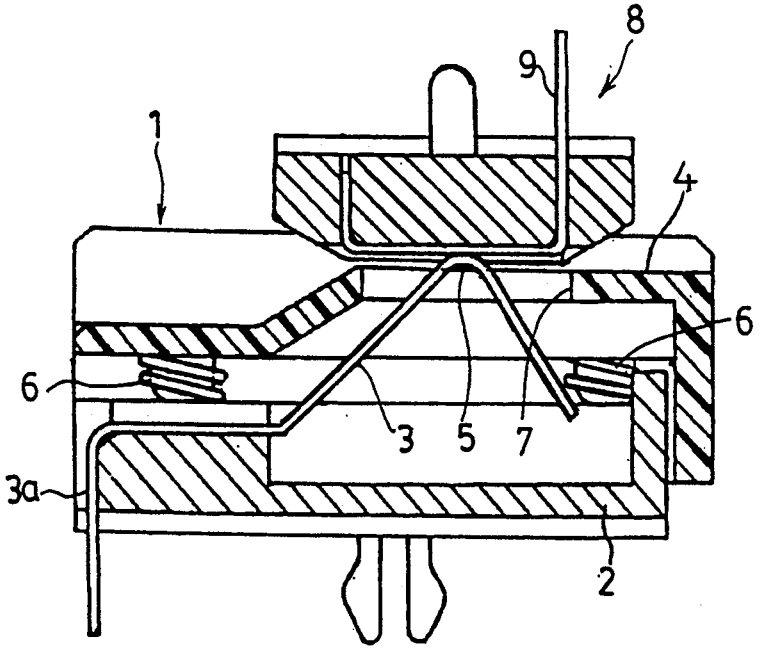
FIG. 25 is a longitudinal sectional view of a conventional connector.

Still another embodiment of the present invention as will be described in detail with reference to FIGS. 21 to 24. FIG. 21 is a front view showing the state that a plug connector is opposed to a socket connector, and FIG. 22 is a side view of the same. In the drawings, since the plug connector and the socket connector are substantially the same as those described above, the corresponding portions are designated by the same reference numerals as those of the socket connector 10 of FIG. 10, and the description thereof will be omitted. In FIG. 21, the molded body 26a of the plug connector 26 is vertically stepped, and the outer surface 26b of the stepped portion is engaged with the inner surface 28c of the guide 28 protruding at the outside of the molded body 11 of the socket connector 10 to be described above. Further, a clearance L is provided between the outer surface 26b of the lower step of the stepped portion of the plug connector 26 and the inner surface 28c of the guide 28.

The guides 28 protruding at the outside of the molded body 11 of the socket connector 10 are provided at both sides of the position to be exposed above from the slit 23 of the metal cover 17, and the metal cover 17 is cut out at the positions of the guide 28 at the side plate 17c of the metal cover 17 so as to eliminate a disturbance in the rotating operation.

The upper portion of the inner surface 28c of the guide 28 is cut out to form a tapered surface 28b. Accordingly, the outer surface 26b of the lower step of the stepped portion of the molded body 26a of the plug connector 26 is first guided to be inserted to the tapered surface 28b, and engaged with the inner surface 28c of the guide of the lower portion of the tapered surface 28b. In this case, since a predetermined clearance L is provided between the inner surface 28c of the guide and the outer surface 26b of the plug connector 26, when the plug connector 26 is engaged with the socket connector 10, even if the plug connector 26 is deviated at the center in a pitch direction, it is corrected in a range of the clearance to be engaged with each other at substantially accurate position, and hence an improper contact between the terminals does not occur.

The present invention may be variously modified within the scope of the spirit of the present invention, and the modifications thereof will be naturally included in the scope of the present invention.

We claim:

1. A connector comprising socket connectors covered with a cover formed with a number of slits and mounted on the upper surface of a molded body including a plurality of socket terminals and formed to expose said socket connectors from the slits, and a plug connector having a plurality of plug terminals opposed to said socket terminals, wherein said cover is formed of metal, said metal cover is pivotally secured at its one end to said molded body to be rotatable, energized upwards by a spring, said spring has a connecting portion to be connected to a ground, thereby conducting said metal cover with ground wherein the slits formed at said metal cover are respectively mounted with separators formed of resin in a window opened at said metal cover.

2. The connector according to claim 1 wherein the pressing portion of said each socket terminal is provided on the rear surface of said metal cover, when said metal cover is pressed, said pressing portion presses said socket terminal to limit the protruding amount of the contact portion formed at the top of said socket terminal constantly.

3. The connector according to claim 2 wherein said each socket terminal is fixed at its base portion to the rear portion of the molded body of said socket connector, bent obliquely upwards at the rear, further bent downwards above the molded body to form a contact portion at the top thereof, and extending rearwards at the distal end thereof.

4. The connector according to claim 2 wherein holes are opened at the sides of the window of said metal cover, and said separator is fixed to the edges of said holes and said window by insert molding.

5. The connector according to claim 1 wherein said spring for energizing upwards said metal cover is restricted in the upward movement of said spring by a first connecting portion provided at the molded body, and restricted in the downward movement of said spring by a second connecting portion to fix said spring to the connector body.

6. The connector according to claims 1 or 5 wherein said each socket terminal is fixed at its base portion to the rear portion of the molded body of said socket connector, bent obliquely upwards at the rear, further bent downwards above the molded body to form a contact portion at the top thereof, and extended rearwards at the distal end thereof.

7. The connector according to claims 1 or 5 wherein holes are opened at the sides of the window of said metal cover, and said separator is fixed to the edges of said holes and said window by insert molding.

8. The connector according to claim 7, wherein said each socket terminal is fixed at its base portion to the rear portion of the molded body of said socket connector, bent obliquely upwards at the rear, further bent downwards above the molded body to form a contact portion at the top thereof, and extending rearwards at the distal end thereof.

9. The connector according to claims 1 or 5 wherein guides are stood at both sides of any of said metal cover and said plug connector, the side of the cover or the plug connector having no said guide is detachably engaged with the inner surface of said guide, and a predetermined clearance is provided between the molded body of said socket connector and said metal cover.

10. The connector according to claim 9 wherein said each socket terminal is fixed at its base portion to the rear portion of the molded body of said socket connector, bent obliquely upwards at the rear, further bent downwards above the molded body to form a contact portion at the top thereof, and extending rearwards at the distal end thereof.

11. The connector according to claim 9 wherein holes are opened at the sides of the window of said metal cover, and said separator is fixed to the edges of said holes and said window by insert molding.

12. The connector according to claims 1 or 5 wherein guides are stood at both sides of any of said metal cover and said plug connector, the side of said metal cover or the plug connector having no said guide is detachably engaged with the inner surface of said guide, and further a predetermined clearance is provided between the inner surface of said guide and the side of said metal cover or the plug connector having no guide.

13. The connector according to claim 12 wherein said each socket terminal is fixed at its base portion to the rear portion of the molded body of said socket connector, bent obliquely upwards at the rear, further bent downwards above the molded body to form a contact portion at the top thereof, and extending rearwards at the distal end thereof.

14. The connector according to claim 12 wherein holes are opened at the sides of the window of said metal cover, and said separator is fixed to the edges of said holes and said window by insert molding.

15. The connector according to claim 12 wherein the pressing portion of said each socket terminal is provided on the rear surface of said metal cover, when said metal cover is pressed, said pressing portion presses said socket terminal to limit the protruding amount of the contact portion formed at the top of said socket terminal constantly.

16. The connector according to claims 1 or 5 wherein guides protrude at both sides of the molded body of said socket connector at the exposed side of said socket terminal, the outer surface of said plug connector is engaged with the inner surface of said guide, and at least one of the upper portion of the inner surface of said guide or the distal end of the outer surface of said plug connector is cut out to form a tapered surface.

17. The connector according to claim 16 wherein said each socket terminal is fixed at its base portion to the rear portion of the molded body of said socket connector, bent obliquely upwards at the rear, further bent downwards above the molded body to form a contact portion at the top thereof, and extending rearwards at the distal end thereof.

18. The connector according to claim 16 wherein holes are opened at the sides of the window of said metal cover, and said separator is fixed to the edges of said holes and said window by insert molding.

19. The connector according to claim 16 wherein the pressing portion of said each socket terminal is provided on the rear surface of said metal cover, when said metal cover is pressed, said pressing portion presses said socket terminal to limit the protruding amount of the contact portion formed at the top of said socket terminal constantly.

* * * * *